US010335617B2

(12) United States Patent
Makhlouche et al.

(10) Patent No.: US 10,335,617 B2
(45) Date of Patent: Jul. 2, 2019

(54) RESPIRATORY PROTECTION EQUIPMENT

(71) Applicant: L'Air Liquide, Societe Anonyme pour l'Etude et l'Exploitation des Procedes Georges Claude, Paris (FR)

(72) Inventors: Rachid Makhlouche, Genoble (FR); Jean-Michel Cazenave, Seyssins (FR); Freddy Dumont, Les Abrets (FR); Christian Rolland, Vif (FR); Vincent Perrard, Brie et Angonnes (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 756 days.

(21) Appl. No.: 14/897,081

(22) PCT Filed: May 2, 2014

(86) PCT No.: PCT/FR2014/051047
§ 371 (c)(1),
(2) Date: Dec. 9, 2015

(87) PCT Pub. No.: WO2014/199028
PCT Pub. Date: Dec. 18, 2014

(65) Prior Publication Data

US 2016/0151649 A1 Jun. 2, 2016

(30) Foreign Application Priority Data

Jun. 12, 2013 (FR) ..... 13 55432

(51) Int. Cl.
*A62B 17/04* (2006.01)
*A62B 7/02* (2006.01)
(Continued)

(52) U.S. Cl.
CPC ..... *A62B 17/04* (2013.01); *A62B 7/02* (2013.01); *A62B 9/02* (2013.01); *A62B 7/14* (2013.01)

(58) Field of Classification Search
CPC ..... A41D 13/1153; A62B 7/00; A62B 7/02; A62B 7/08; A62B 7/14; A62B 9/00;
(Continued)

(56) References Cited

U.S. PATENT DOCUMENTS 3,762,407 A * 10/1973 Shonerd ..... A62B 7/02 128/201.23
3,976,063 A * 8/1976 Henneman ..... A62B 7/10 128/201.25
(Continued)

FOREIGN PATENT DOCUMENTS

FR 2 582 524 12/1986
GB 2119660 A * 11/1983 ..... A62B 7/02
(Continued)

OTHER PUBLICATIONS

International Search Report for PCT/FR2014/051047, dated Nov. 5, 2014.
(Continued)

*Primary Examiner* — Jan Christopher L Merene
*Assistant Examiner* — Joseph D. Boecker
(74) *Attorney, Agent, or Firm* — Christopher J. Cronin

(57) ABSTRACT

Respiratory protection hood comprising a flexible envelope and a reservoir of pressurized oxygen comprising an outlet orifice that leads into the internal volume of the envelope, the outlet orifice being closed off by a removable stopper, characterized in that the reservoir of oxygen comprises, upstream of the orifice, a passage for the pressurized gas and a needle that is able to move in a given direction of displacement in said passage, the needle being subjected to
(Continued)

two opposite forces in the direction of displacement, said forces being respectively generated on the one hand by the pressure of the gas in the reservoir and the other hand by a return member, the needle having a section with a defined profile that is variable in the direction of displacement in order to modify the degree of closure of the passage depending on the position of said needle relative to the passage so as to regulate the flow rate of gas allowed to escape via the passage towards the orifice as a function of time and the pressure of gas in the reservoir.

12 Claims, 2 Drawing Sheets

(51) Int. Cl.
*A62B 9/02* (2006.01)
*A62B 7/14* (2006.01)

(58) Field of Classification Search
CPC ..... A62B 9/02; A62B 9/027; A62B 17/00; A62B 17/04; A62B 18/00; A62B 18/003; A62B 18/02; A62B 18/084; A42B 3/28; A42B 3/288
See application file for complete search history.

(56) References Cited

U.S. PATENT DOCUMENTS

| | | | | |
|---|---|---|---|---|
| 4,889,113 | A * | 12/1989 | Pelloux-Gervais .... | A62B 17/04 128/201.25 |
| 6,247,471 | B1 * | 6/2001 | Bower ..... | A62B 7/02 128/201.23 |
| 2002/0179153 | A1 * | 12/2002 | Taylor ..... | A62B 9/02 137/540 |
| 2016/0030776 | A1 * | 2/2016 | Rolland ..... | A62B 17/04 128/204.25 |
| 2016/0121146 | A1 * | 5/2016 | Makhlouche ..... | A62B 7/02 128/201.28 |

FOREIGN PATENT DOCUMENTS

| | | | | |
|---|---|---|---|---|
| GB | 2193644 A | * | 2/1988 | ..... A62B 9/00 |
| GB | 2201096 A | * | 8/1988 | ..... A62B 7/02 |
| WO | WO 2004 018045 | | 3/2004 | |

OTHER PUBLICATIONS

French Search Report and Written Opinion for FR1355432, dated Feb. 25, 2014.

* cited by examiner

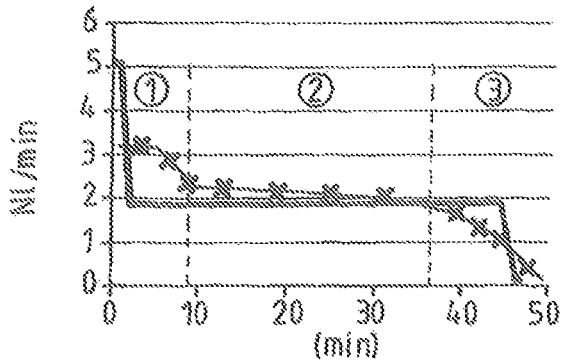
FIG.5
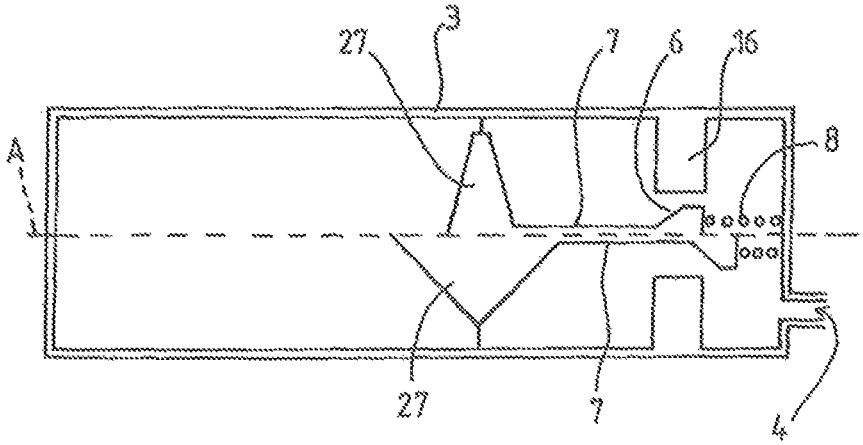
FIG.6
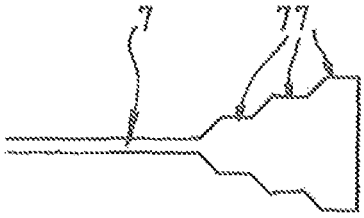
FIG.7
FIG.8
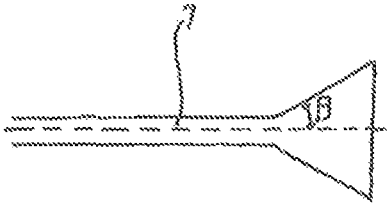
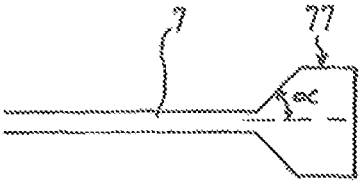
FIG.9

RESPIRATORY PROTECTION EQUIPMENT

CROSS-REFERENCE TO RELATED APPLICATIONS

This application is a § 371 of International PCT Application PCT/FR2014/051047, filed May 2, 2014, which claims § 119(a) foreign priority to French patent application 1355432, filed Jun. 12, 2013.

BACKGROUND

Field of the Invention

The present invention relates to respiratory protection equipment, commonly referred to as a hood.

The invention relates more particularly to a respiratory protection hood comprising a flexible bag intended to be slipped over the head of a user and a reservoir of pressurized oxygen comprising an outlet orifice opening into the internal volume of the flexible bag, the outlet orifice being closed off by a removable or contrived-rupture stopper.

Related Art

This type of device, which needs to comply with standard TSO-C-116a, is conventionally used onboard airplanes when the cabin atmosphere is vitiated (depressurization, smoke, chemical agents, etc.).

These hoods must notably allow the flight crew to tackle the problem, provide emergency assistance to the passengers, and manage a potential evacuation of the aircraft.

The technical specifications for such devices are defined according to class of use (in-flight damage, protection against high-altitude hypoxia, emergency evacuation on the ground, etc.).

The device needs to be able to supply the user with enough oxygen to meet the demands of use.

The hood may notably be provided both for preventing hypoxia at an altitude of 40 000 feet two minutes after it has been donned and then, in the final minutes of use, supplying enough oxygen to allow evacuation.

Known respiratory protection equipment chiefly employs two types of oxygen source:

- a chemical brick (also referred to as a "chemical oxygen generator") that generates oxygen by combustion (potassium superoxide—$KO_2$, sodium chlorate—$NaClO_3$, etc.), or
- a compressed-oxygen reservoir associated with a calibrated orifice.

The first type allows the supply of a flow rate of oxygen that increases until it reaches a relatively constant level before dropping off rapidly at the end of combustion.

Generators of the chemical oxygen generator type, if correctly sized, may constitute a source of oxygen that is capable of meeting the desired requirements, but this solution does have a major disadvantage: the combustion reaction of the oxygen generator is highly exothermal.

As a result, the external surface temperature of the device may easily exceed 200° C. and ignite any combustible material in contact with it (a fatal accident has already occurred following accidental activation of such a chemical oxygen generator in a transport container situated in the hold of an airplane).

This type of device also has the disadvantage of requiring a certain time for the oxygen flow rate to rise upon startup. This may entail the addition of an additional oxygen capacity for startup. Finally, these devices require filters in order to remove the impurities generated by the oxygen-producing reaction.

The second type (pressurized—oxygen reservoir associated with a calibrated orifice) supplies an oxygen flow rate that decreases exponentially, in proportion to the pressure inside the reserve.

Hoods using this second type thus generally comprise a source of oxygen that allows an individual to be supplied with oxygen for 15 minutes. This equipment also has a means of limiting the pressure inside the hood (for example an overpressure relief valve).

This technology using compressed oxygen in a sealed container associated with a calibrated orifice is safer. Nevertheless, in order to be able to meet certain usage scenarios (substantial oxygen consumption at the end of use corresponding, for example, to an emergency evacuation of the aircraft), the container needs to have a volume that is too great for the target size. Another solution may be to provide a high initial pressure (in excess of 250 bar). That generates a high initial flow rate, for example of more than ten normal liters per minute (Nl/min) so as to be able to have enough flow rate at the end of use (for example more than 2 Nl/min at the fifteenth minute of use of the equipment). An excessive oxygen flow rate, although advantageous in affording protection against hypoxia, is, however, problematical if there is a fire onboard the aircraft because the excess oxygen will be discharged from the equipment through the overpressure relief valve thereof and may feed the flames. In addition, it entails oversizing the oxygen reservoir and this is a major disadvantage in terms of mass, size and cost.

SUMMARY OF THE INVENTION

The invention relates to a hood using a pressurized-oxygen reservoir.

One object of the present invention is to alleviate all or some of the abovementioned disadvantages of the prior art.

One object of the invention may notably be to propose a hood that makes it possible to supply a relatively large quantity of oxygen at the start of use (to prevent high-altitude hypoxia) while at the same time allowing a sufficient quantity of oxygen to be supplied at the end of use (after ten or fifteen minutes) to allow evacuation.

To this end, the hood according to the invention, in other respects in accordance with the generic definition thereof given in the above preamble, is essentially characterized in that the pressurized-oxygen reservoir comprises, upstream of the orifice, a passage for the pressurized gas and a valve needle able to move in a determined direction of travel in said passage, the valve needle being subjected to two opposing forces in the direction of travel, these being generated respectively, on the one hand, by the pressure of the gas in the reservoir and, on the other hand, by a return member, the valve needle having a cross section of determined profile that can vary in the direction of travel in order to alter the degree of closure of the passage according to its position relative to the passage so as to regulate the flow rate of gas allowed to escape via the passage to the orifice as a function of time and as a function of the pressure of gas in the reservoir.

Moreover, some embodiments of the invention may comprise one or more of the following features:

- the valve needle has a cross section of determined profile in the direction of travel so as to control the flow rate of gas allowed to escape via the passage to the orifice according to a predetermined curve as a function of time and as a function of the initial pressure of gas in the reservoir, the valve needle has a cross section of determined profile in the direction of travel to control the flow rate of gas allowed to escape via the passage to the orifice as a function of time according to a curve comprising a first phase delivering a first flow rate of between 3 Nl/min and 8 Nl/min when the pressure in the reservoir is between 250 bar and 100 bar, then a second phase delivering a second flow rate of between 2 Nl/min and 5 Nl/min when the pressure in the reservoir is between 100 bar and 30 bar, the valve needle has a cross section of determined profile in the direction of travel, to control the flow rate of gas allowed to escape from the reservoir via the passage to the orifice as a function of time according to a curve having substantially constant successive levels, which means to say that, for a gas initially stored at an initial pressure of between 250 bar and 100 bar in the reservoir, the levels display a decrease in flow rate of less than 1 Nl/min, said levels comprising a first flow rate level of between 3 and 6 Nl (normal liters) per minute for a duration of between one and five minutes after the start of opening of the calibrated orifice, and a second flow rate level of between 1.6 and 3 Nl per minute for a duration of between 5 and 25 minutes after the start of opening of the calibrated orifice, the passage is formed in a partition delimiting an intermediate chamber between the calibrated orifice and the rest of the interior volume of the reservoir, said intermediate chamber being placed at the exterior pressure via the calibrated orifice upon opening of the stopper, the valve needle has an end able to move in the intermediate chamber, the return member being housed in the intermediate chamber and applying its force to this end, the valve needle has a cross section of increasing diameter, the valve needle has a profile of increasing diameter which also has at least one level of constant diameter, the valve needle comprises a deformable fluidtight capsule containing a gas at a determined pressure, notably an altimetric capsule, said capsule pressing against at least one wall of the reservoir and deforming according to the pressure within the reservoir so as to cause a determined movement of the valve needle in a direction of travel as a function of the pressure in the reservoir, the flexible bag is fluidtight, the oxygen reservoir is secured to the base of the flexible bag, the oxygen reservoir is of tubular overall shape, notably shaped into a C, to allow it to be placed around the neck of a user, the base of the flexible bag forms a flexible diaphragm intended to fit around the neck of a user, the hood comprises a $CO_2$ absorption device which communicates with the inside of the bag, the bag has an opening through which the $CO_2$ absorption device is positioned, the capsule is made of at least one of the materials from the following: a steel, an alloy of copper or of bronze, the valve needle is dimensioned so that 350-bar pressure variations in the reservoir cause the valve needle a translational movement in the direction over a distance of between 1 to 10 mm and preferably of between 1 to 4 mm.

The invention may also relate to any alternative method or device comprising any combination of the features above or below.

BRIEF DESCRIPTION OF THE FIGURES

Other specifics and advantages will become apparent from reading the following description, which is given with reference to the figures in which:

FIG. 5 is an example of curves of oxygen flow rates that can be supplied via a reservoir according to FIG. 2, FIG. 6 is a cross section depicting a detail of the hood of FIG. 1 illustrating a second embodiment of the pressurized-oxygen reservoir, the two halves of the cross section corresponding respectively to two operating configurations, FIGS. 7 to 9 are partial and schematic views illustrating three alternative forms of embodiment of a valve needle that can be used in a reservoir according to the invention.

DETAILED DESCRIPTION OF THE INVENTION

Figure 1:
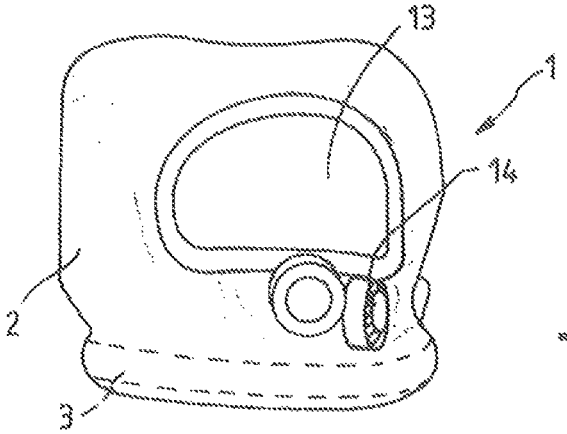
FIG. 1 depicts a face-on and schematic view illustrating one example of a hood according to the invention.

The hood illustrated in FIG. 1 comprises in a conventional way a flexible bag 2 (preferably fluidtight) intended to be slipped over the head of a user. A transparent visor 13 is provided on the front face of the bag 2. The hood 1 also comprises a pressurized-oxygen reservoir 3 positioned for example at the base of the bag 2.

In the conventional way, the base of the flexible bag 2 may comprise or form a flexible diaphragm intended to be fitted around the neck of a user in order to provide sealing.

In the conventional way also, the hood 1 may comprise a $CO_2$ absorption device (not depicted) which communicates with the inside of the bag 2, so as to remove $CO_2$ from the air exhaled by the user. For example, the bag 2 may comprise an opening across which the $CO_2$ absorption device is positioned. Likewise, another opening may be provided for a relief valve 14 provided for preventing an overpressure in the bag 2.

As illustrated in FIG. 1, the oxygen reservoir 3 may have a tubular overall shape, notably shaped as a C, to allow it to be placed around the neck of a user.

Figure 2:
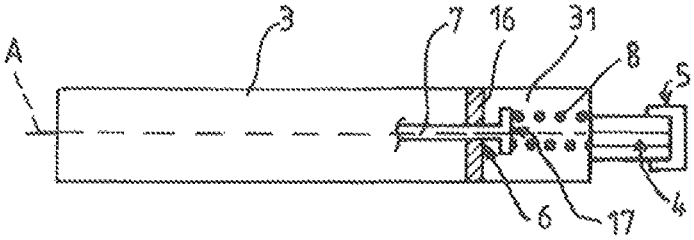
FIG. 2 is a cross section depicting a detail of the hood of FIG. 1, illustrating a first embodiment of the pressurized-oxygen reservoir.

As illustrated in FIG. 2, the reservoir 3 comprises an outlet orifice 4 opening into the internal volume of the flexible bag 2 so as to deliver pure gaseous oxygen or an oxygen-enriched gas to the user. The reservoir 3 also comprises at least one filling orifice (which for the sake of simplicity has not been depicted).

The outlet orifice 4 is normally closed off by a removable or contrived-rupture stopper 5 and will be opened only in the event of use.

For example, when the stopper 5 is broken/removed, the orifice 4 causes the outside to communicate with the internal volume of the reservoir 3.

According to one advantageous feature, the reservoir 3 of pressurized (pure or predominantly) oxygen comprises, upstream of the stopper 5, a passage 6 for the pressurized gas and a valve needle 7 able to move in a determined direction A of travel in said passage 6. For preference, the valve needle 7 is able to move translationally in the direction A of travel.

Figure 3:
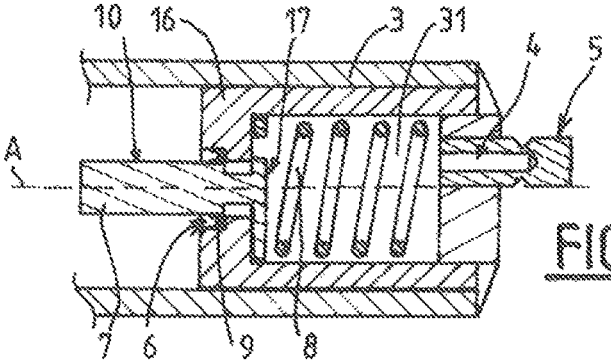
FIGS. 3 and 4 are enlarged views in cross section of a detail of the reservoir of FIG. 2, in two operating configurations respectively.
Figure 4:
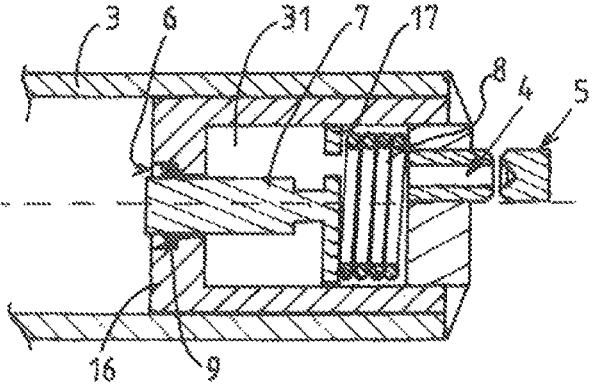

As can be seen in the example of FIGS. 2 to 4, the passage 6 may be formed in a partition 16 delimiting an intermediate chamber 31 between the outlet orifice 4 and the rest of the interior volume of the reservoir 3. This dividing partition 16 may be secured to a housing inserted at one end of the reservoir 3. This housing may incorporate the frangible stopper 5. The volume of the intermediate chamber 31 corresponds for example to one tenth to one fiftieth of the total volume of the reservoir 3.

The valve needle 7 may collaborate with a seal 9 positioned in the region of the passage 6.

The valve needle 7 is subjected to two opposing movement forces in the direction A, these being generated respectively, on the one hand, by the pressure of the gas in the reservoir 3 and, on the other hand, by a return member 8.

For example, the pressure of gas in the reservoir 3 pushes the valve needle 7 toward the outlet orifice 4 whereas the return member 8 (for example a compression spring) pushes the valve needle 7 back in the opposite direction. The valve needle 7 may thus comprise an end 17 able to move in the intermediate chamber 31 on which end the spring 8 applies its force.

The valve needle 7 has a cross section of determined profile 10 that can vary in the direction A of travel to alter the degree of closure of the passage according to its position relative to the passage 6. This profile 10, which may have longitudinal grooves in the direction A of travel, is configured to regulate the flow rate of gas allowed to escape via the passage 6 to the outlet orifice 4 opened when the stopper 5 is removed.

In this way, the valve needle 7 has a cross section of determined profile in the direction A of travel so as to control the flow rate of gas allowed to escape via the passage 6 to the calibrated orifice 4 according to a predetermined curve as a function of time and as a function of the initial pressure in the reservoir 3.

For example, the valve needle 7 has a cross section of determined profile 10 in the direction A of travel that is determined so as to control the flow rate of gas allowed to escape according to a curve comprising a first phase delivering a first flow rate of between 3 Nl/min and 8 Nl/min (Nl=normal liter) when the pressure in the reservoir is between 250 bar and 100 bar, then a second phase delivering a second flow rate of between 2 Nl/min and 5 Nl/min when the pressure in the reservoir 3 is between 100 bar and 30 bar.

When the stopper 5 is in place, the reservoir 3 contains pressurized gas, including in the intermediate chamber 31 (cf. FIG. 3).

When the stopper 5 is broken, the orifice 4 places the intermediate chamber 31 in fluidic communication with the outside. The intermediate chamber 31 and therefore the spring 8 then find themselves at the exterior pressure. Gas escapes at a controlled flow rate through the passage formed between the profile 10 of the valve needle 7 and the border of the passage 6. The valve needle 7 is moved by the pressure in the reservoir (this force predominates over the force of the spring 8 which finds itself compressed, cf. FIG. 4).

As the pressure of gas in the reservoir 3 decreases, the spring 8 once again moves the valve needle 7 against the action of the gas pressure (toward the left in FIG. 4). Depending on the chosen profile 10 to which the valve needle 7 has been machined, the flow rate released may evolve in various predetermined manners.

Such an example of a variation in the flow rate of gas supplied (in normal liters Nl, which means to say in liters of gas under determined temperature T=0° C. and pressure P=1 atm conditions) as a function of time (in seconds) is indicated by a first curve with crosses in FIG. 5.

This first curve is obtained using a valve needle 7 that has a cross section of determined profile in the direction A of travel. This curve creates substantially constant successive levels which means to say that for a gas initially stored at a determined initial pressure in the reservoir 3, the flow rate allowed to escape via the outlet orifice 4 is first of all substantially constant about a determined first value (for example 3.2 Nl per minute for around 6 minutes). Then this flow rate subsequently decreases to reach a substantially constant second level at a determined value of around 2 Nl/minute (for around 25 minutes).

FIG. 5 viewed in continuous line depicts another more theoretical flow rate curve that can be approximated to by a device according to the invention. This curve comprises a short first level (lasting around 1 to 2 minutes) at a relatively high flow rate (around 5.2 Nl per minute for example) followed by a decrease in flow rate down to a second level (for example around 1.8 Nl per minute for around 35 minutes) before decreasing.

Thus, by choosing the profile of the cross section of the valve needle 7 it is possible to determine the overall shape of the curve indicating the flow rate of gas from the reservoir 3. This means that the emptying of the gas reservoir 2 can be configured to suit user requirements according to the circumstances or class of use of the hood 1 (high initial flow rate for emergency intervention, followed by stabilization of the flow rate during emergency landing and high flow rate during the phase of evacuating the craft).

As illustrated in FIG. 6, the valve needle 7 may comprise a deformable fluidtight capsule 27 containing a gas at a determined pressure, notably an altimetric capsule. The altimetric capsule 27 (also referred to as a pressure altimeter) may be made of stainless steel, steel or any other suitable material. This capsule 27 forms a fluidtight volume containing a gas at constant pressure (generally a pressure of close to a vacuum, for example between 0.1 bar and 1 bar) throughout its lifespan. The gas contained in the capsule 27 is, for example, air.

When the pressure in the reservoir 3 is high (150 bar for example), the capsule 27 is compressed (cf. the upper part of FIG. 6). By contrast, as the pressure within the reservoir 3 decreases, the volume of the capacity increases. This increase in volume of the capsule by reaction moves the valve needle 7 to a position of wider opening (cf. bottom part of FIG. 6 (and vice versa).

Specifically, the variation in volume of the capsule 27 moves the valve needle 7 with respect to the body of the reservoir 1 and causes the distance between the valve needle 7 and the passage 6 to vary in the direction A of travel. The flow rate is therefore modified by modifying the open cross section at the passage.

Such mechanisms are used in pneumatic-mechanical oxygen regulators in order to perform the altimetric overpressure function. They are also used in the automotive industry to reduce intake during braking phases.

Different types of flow rate profile can be obtained according to the profile of the valve needle 7.

FIG. 7 schematically illustrates a valve needle 7 of which the cross section can vary and has several different levels 77 of constant diameter. Such a profile makes it possible to obtain variations in cross section at the passage between three constant passage cross sections.

FIG. 8 illustrates a profile of valve needle 7 having a cross section of linearly increasing diameter. This may make it possible to obtain a passage cross section that can vary according to the position with respect to the passage 6.

FIG. 9 illustrates a profile of valve needle 7 comprising a diameter that increases up to a level of constant diameter. Such a profile makes it possible to obtain a passage cross section that can vary as a function of the position in the direction A of travel followed by a constant passage cross section.

Of course, other profiles may be envisioned (cross section of non-linearly variable diameter, etc.).

The embodiments of FIGS. 2 and 6 may comprise a single filling orifice (preferably distinct from and opposite the calibrated outlet orifice 4).

These embodiments given by way of example allow control over the flow rate supplied to the bag 2 of the hood with a great deal of freedom on dimensioning.

In addition, the mobile valve needle 7 does not need a long travel in the direction A of travel; a few millimeters (1 to 4 mm for example) may be enough to control flow rates for a duration of 15 to 30 minutes for example for all the classes (1 to 4) of use of the hood 1.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A respiratory protection hood, comprising: a flexible bag adapted and configured to be slipped over a head of a user; and a reservoir of pressurized oxygen comprising an outlet orifice opening into an internal volume of the flexible bag, the outlet orifice being closed off by a removable or contrived-rupture stopper, wherein:

the pressurized-oxygen reservoir comprises, upstream of the orifice, a passage for the pressurized gas and a valve needle able to move in a determined direction of travel in said passage;

the valve needle is subjected to two opposing forces in the direction of travel that are respectively generated, on one hand, by the pressure of the gas in the reservoir, and on the other hand, by a return member;

the valve needle has a cross section of determined profile that varies in the direction of travel in order to alter a degree of closure of the passage according to its position relative to the passage so as to regulate the flow rate of gas allowed to escape via the passage to the orifice as a function of time and as a function of the pressure of gas in the reservoir.

2. The hood of claim 1, wherein the cross section of determined profile varies in the direction of travel so as to control the flow rate of gas allowed to escape via the passage to the orifice according to a predetermined curve as a function of time and as a function of the initial pressure of gas in the reservoir.

3. The hood of claim 1, wherein the cross section of determined profile varies in a direction of travel to control the flow rate of gas allowed to escape via the passage to the orifice as a function of time according to a curve comprising a first phase delivering:

a first flow rate of between 3 L(std)/min and 8 L(std)/min when a pressure in the reservoir is between 250 bar and 100 bar;

then, a second phase delivering a second flow rate of between 2 L(std)/min and 5 L(std)/min when a pressure in the reservoir is between 100 bar and 30 bar.

4. The hood of claim 1, wherein the cross section of determined profile varies in the direction of travel, to control the flow rate of gas allowed to escape from the reservoir via the passage to the orifice as a function of time according to a curve having substantially constant successive levels, which means to say that, for a gas initially stored at an initial pressure of between 250 bar and 100 bar in the reservoir, the levels display a decrease in flow rate of less than 1 L(std)/min, said levels comprising:

a first flow rate level of between 3 and 6 L(std)/min for a duration of between one and five minutes after a start of opening of the calibrated orifice; and a second flow rate level of between 1.6 and 3 L(std)/m in for a duration of between 5 and 25 minutes after the start of opening of the calibrated orifice.

5. The hood of claim 1, wherein the passage is formed in a partition delimiting an intermediate chamber between the calibrated orifice and a rest of the interior volume of the reservoir, said intermediate chamber being placed at the exterior pressure via the calibrated orifice upon opening of the stopper.

6. The hood of claim 5, wherein the valve needle has an end able to move in the intermediate chamber and in that the return member is housed in the intermediate chamber and applies its force to this end.

7. The hood of claim 1, wherein the valve needle has a cross section of increasing diameter.

8. The hood of claim 7, wherein the valve needle has a profile of increasing diameter which also has at least one level of constant diameter.

9. The hood of claim 1, wherein the valve needle comprises a deformable fluidtight altimetric capsule containing a gas at a determined pressure, said capsule pressing against at least one wall of the reservoir and deforming according to the pressure within the reservoir so as to cause a determined movement of the valve needle in the direction of travel as a function of the pressure in the reservoir.

10. The hood of claim 1, wherein the flexible bag is fluidtight.

11. The hood of claim 1, wherein the oxygen reservoir is secured to a base of the flexible bag.

12. The hood of claim 1, wherein the oxygen reservoir is of C-shaped tubular overall shape to allow it to be placed around a neck of the user.

* * * * *